US006486777B2

(12) United States Patent
Clark

(10) Patent No.: US 6,486,777 B2
(45) **Date of Patent: *Nov. 26, 2002**

(54) PERSONAL MONITORING APPARATUS AND METHOD

(76) Inventor: Albert M. Clark, 124 Park Ave., Casselberry, FL (US) 32707

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/374,793

(22) Filed: Aug. 16, 1999

(65) Prior Publication Data

US 2001/0050613 A1 Dec. 13, 2001

(51) Int. Cl.[7] ..... G08B 1/08

(52) U.S. Cl. ..... 340/539; 340/573.1; 340/572.1; 340/604; 340/573.4; 340/573.6; 440/1

(58) Field of Search ..... 340/573.1, 539, 340/573.4, 573.6, 604, 506, 693, 605; 307/9.1; 440/1

(56) References Cited

U.S. PATENT DOCUMENTS 5,029,293 A * 7/1991 Fontanille ..... 340/573.1
5,461,365 A * 10/1995 Schlager et al. ..... 340/573.4
5,525,967 A * 6/1996 Azizi et al. ..... 340/572.1
5,689,240 A * 11/1997 Traxler ..... 340/573.4
5,771,002 A * 6/1998 Creek et al. ..... 340/539
6,057,759 A * 5/2000 Marsh ..... 340/539

* cited by examiner

*Primary Examiner*—Daryl C. Pope
(74) *Attorney, Agent, or Firm*—Allen, Dyer, Doppelt, Milbrath & Gilchrist, P.A.

(57) ABSTRACT

A apparatus and method for an operator to monitor the whereabouts of a subject, the apparatus comprising a portable remote unit connected to the subject, the remote unit including a remote unit power supply, a radio transmitter for sending a substantially constant remote unit radio signal, a radio receiver for receiving a base unit radio signal, a remote unit alarm, and a dye pack for releasing dye substantially responsive to submersion of the remote unit in water. The apparatus also includes a base unit in radio communication with the remote unit for enabling the operator to monitor the whereabouts of the remote unit, the base unit including a base unit power supply, a radio transmitter for sending the base unit radio signal, a radio receiver for receiving the substantially continuous remote unit radio signal, a distance estimator for substantially estimating the distance between the base unit and the remote unit, a base unit alarm responsive to the remote unit radio signal so that the base unit alarm is activated when the remote unit radio signal is altered, and a direction finding function for generally finding the direction from which the remote unit signal originates, relative to remote unit radio signal strength.

38 Claims, 5 Drawing Sheets

PERSONAL MONITORING APPARATUS AND METHOD

FIELD OF THE INVENTION

The present invention relates to the field of personal alarms and, more particularly, to a personal alarm apparatus intended to aid against accidental drowning, including a method for an operator to monitor the whereabouts of a subject in or out of the water.

BACKGROUND OF THE INVENTION

The present invention provides a personal monitoring apparatus useful in helping prevent accidental drownings, particularly with children, the elderly, and handicapped subjects. Additionally, the apparatus is useful for monitoring separation distance, thus helping prevent a monitored subject from wandering away from a supervising operator. Similar systems including compact, portable monitoring units have been previously described and are known in the art. However, no previous system incorporates all the features and advantages of the present invention. The present invention provides water-activated warning systems, a distance warning, a manually activated warning, directional finding capability, and the ability for one base station to individually monitor multiple remote stations. This last function being particularly useful in group situations, such as summer camps, daycares, nursery schools, elder care, and others.

SUMMARY OF THE INVENTION

With the foregoing in mind, the present invention advantageously provides a personal monitoring apparatus and method for an operator to monitor the whereabouts of a subject. The apparatus includes one or more portable remote units and a base unit. The portable remote unit is connected to the subject to be monitored and includes a remote unit power supply, a radio transmitter for sending a remote unit radio signal, a radio receiver for receiving a base unit radio signal, remote unit alarm having a light activated water sensor, and a dye pack for releasing dye substantially responsive to submersion of the remote unit in water. The remote unit may include a power switch positioned such as to substantially prevent the remote unit from being turned off by the subject. The apparatus also includes a portable base unit in radio communication with the remote unit for enabling the operator to monitor the whereabouts of the remote unit, and thereby also the whereabouts of the subject. The base unit includes a base unit power supply, a radio transmitter for sending the base unit radio signal, a radio receiver for receiving the remote unit radio signal, a distance estimating function for substantially estimating the distance between the base unit and the remote unit, a base unit alarm responsive to the remote unit radio signal, and a direction finding function for generally finding the direction from which the remote unit signal originates. Both the base unit and the remote unit may be housed in an accessory or a garment. For example, the base unit may be housed in an accessory such as a wrist band to be worn by the operator performing the monitoring. The remote unit may be housed in a garment, such as a shirt to be worn by the subject, perhaps a child. The apparatus incorporates an alarm activated by excessive distance between the remote unit and the base unit or by the remote unit being submerged in water. An alarm on the remote unit may also be activated manually from the base unit at the operator's discretion.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime notation when used indicates similar elements in alternative embodiments.

FIGS. 1 through 4 illustrate the personal monitoring apparatus for an operator to monitor the whereabouts of a subject. The personal monitoring apparatus includes a base unit 10 used by the operator who is the monitor, and a remote unit 30 carried by the subject being monitored. The subject may preferably be a child, a handicapped or elderly person, such as a person suffering from Alzheimer's disease, or even a pet animal such as a dog.

Figure 1:
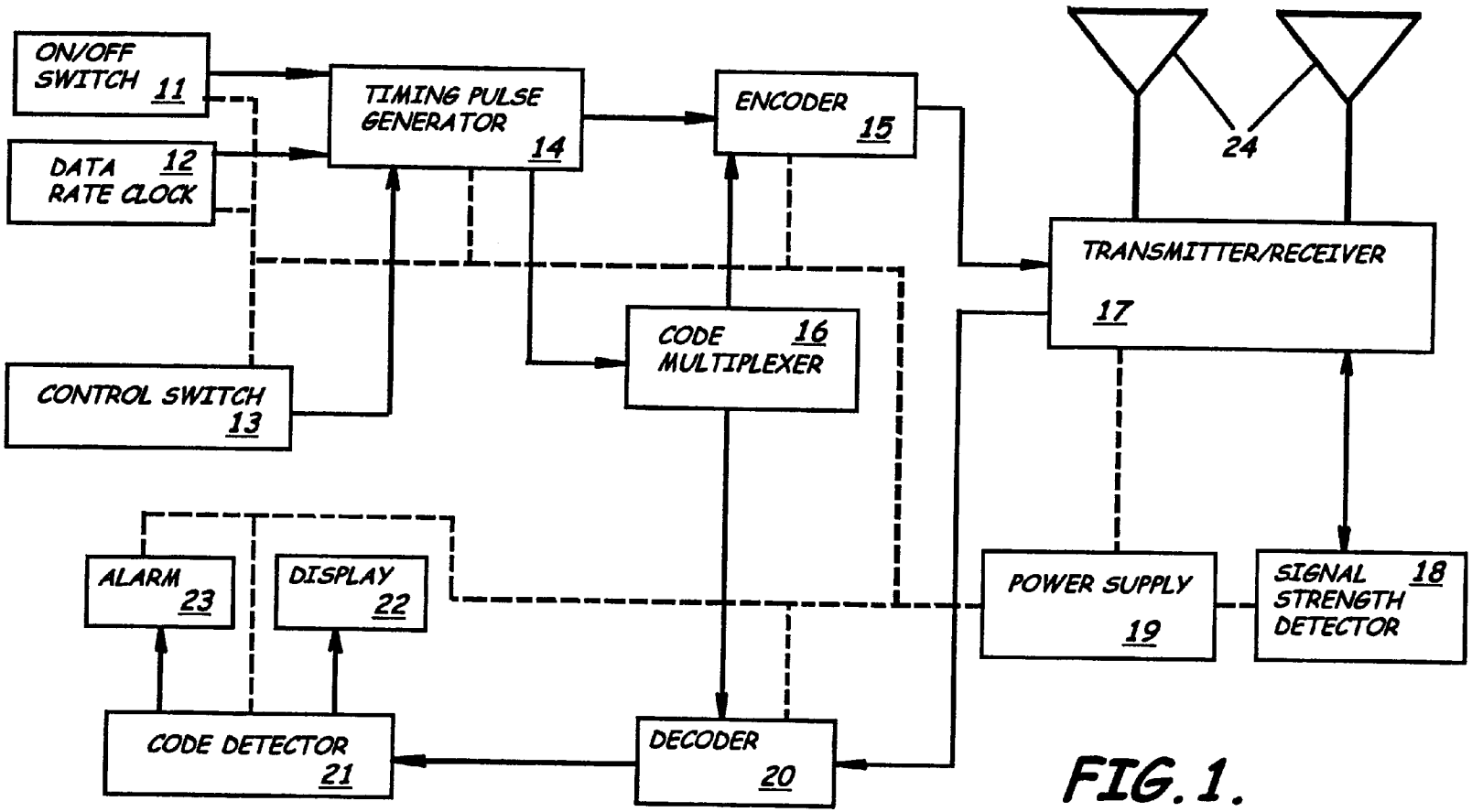
FIG. 1 is a schematic diagram of the base unit according to an embodiment of the present invention.

FIG. 1 is a schematic diagram illustrating components of the base unit 10 as known to those skilled in the art and according to an embodiment of the present invention. The base unit 10 includes an on-off switch 11, a data rate clock 12, and a control switch 13. Control switch 13 may be used by the operator to set the number of remote units which will be monitored by the base unit 10. A timing pulse generator 14 produces codes to advance the code multiplexer 16 to cycle through a monitoring sequence by changing codes so that the transmitter/receiver 17 monitors various remote units in sequence. An encoder 15 sets the code to be sent to specific remote units by the transmitter/receiver 17. Antennas 24 are detachably connected to the transmitter/receiver 17 for signal reception. A signal strength detector 18 provides signal strength information to provide an aid in determining proximity of the base unit 10 to the remote unit 30. A decoder 20 identifies which remote unit's signal is being received. A code status detector 21 identifies any changes in the received signal, which would correlate with a status change in the remote unit 30, for example, whether the unit is submerged, or its batteries are weak. A display 22 provides a visual indicator for the operator. An alarm 23 warns of a condition requiring the operator's attention. The alarm may include an audible tone, and a visible warning and location aid such as a strobe light. Those skilled in the art will know that a power supply 25 is understood to be operably connected to the various components of the unit.

The apparatus also includes a portable remote unit 30 connected to the subject in some fashion, depending on the characteristics of the subject. For example, where the subject is a child or a handicapped person, the portable remote unit 30 may be housed in a garment to be worn by the subject. When the subject is a pet, the portable remote unit 30 may be housed in a harness which the animal may wear.

Figure 2:
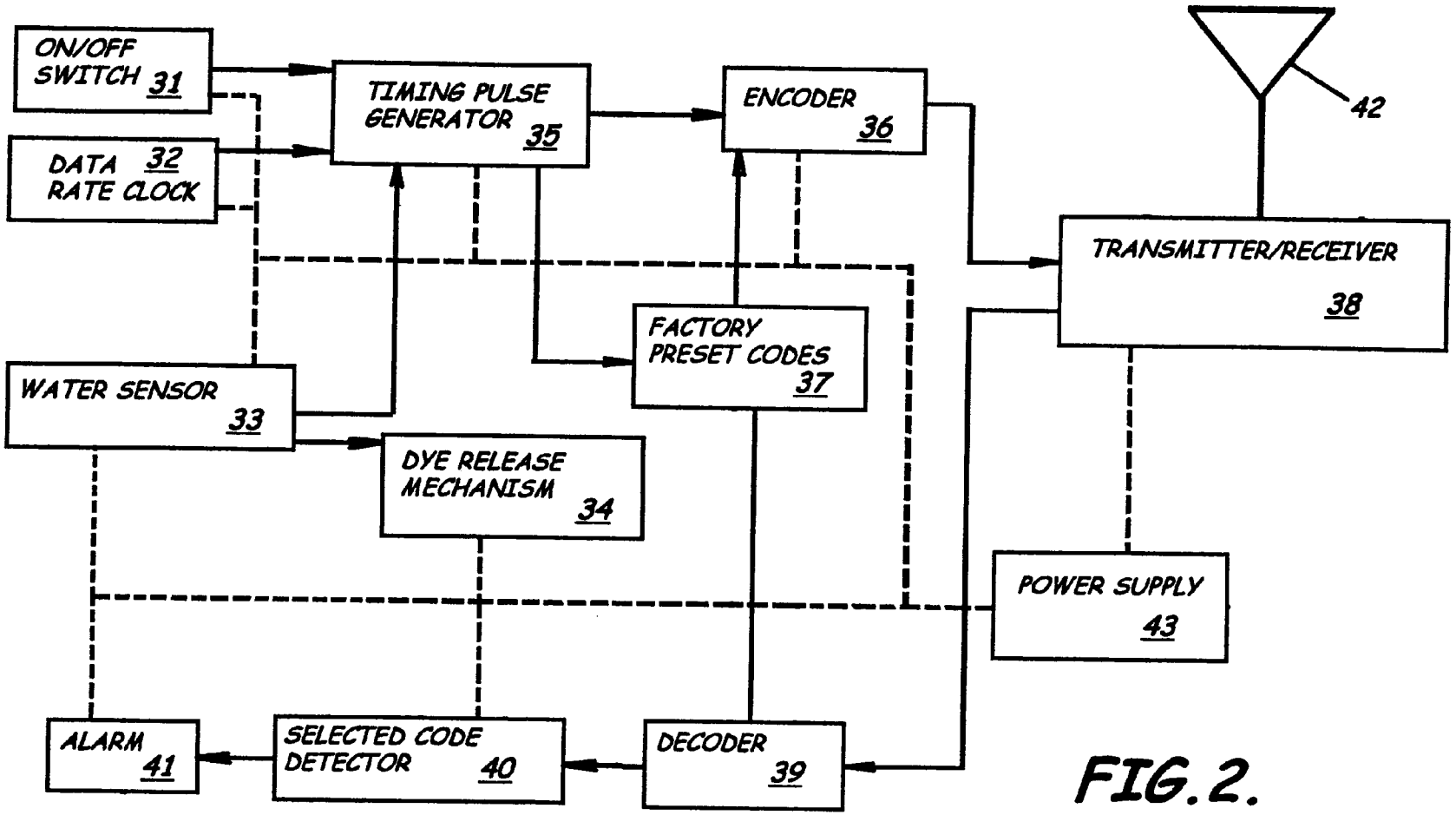
FIG. 2 shows a schematic diagram of the remote unit.

Components of the portable remote unit 30 are schematically illustrated in FIG. 2. The portable remote unit generally includes a remote unit power supply 43 which, as known to the skilled artisan, will be connected to the various other components of the remote unit 30. The remote unit 30 also includes a radio transmitter/receiver 38 for sending a remote unit radio signal which is preferably a continuous signal and for receiving a base unit 10 radio signal, a remote unit alarm 41 responsive to a light activated water sensor 33, and a dye pack and release mechanism 34 for releasing dye substantially responsive to submersion of the remote unit 30 in water. As with the base unit, the remote unit includes a data rate clock 32, a timing pulse generator 35, and encoder 6 having a unit-specific, factory preset code 37, a decoder 39 for recognizing signals received from the base unit, and a code status detector 40 for identifying a change in the received signal.

When the remote unit 30 is activated by the on-off switch 31, it begins sending a constant radio signal. By the term constant, it is meant that the remote unit radio signal may be continuous, or may preferably be a pulsed signal repeating at intervals, to thereby conserve power consumption and help extend the life of the battery, which is a preferred power supply for the remote unit 30. The radio transmitter/receiver 38 may operate at any suitable frequency, and preferably at from about 450 Megahertz to about 916.5 Megahertz, having an approximate range of about 100 yards. The remote unit 30 further includes an alarm 11 which may be manually activated by the operator from the base unit 10, or may be set to self-activate in response to a base unit 10 radio signal sent when the separation between the remote unit 30 and the base unit 10 exceeds a preset distance. When the subject carrying the remote unit 30 is responsive to commands, for example, an older child, setting off the alarm in the remote unit 30 could be used to signal the child to return to the parent or operator of the base unit 10.

The remote unit 30 includes a water sensor 33 having a light emitting diode, a prism, and a light detector. The water sensor 33 includes a prism, preferably of glass, positioned so as to substantially collect the collected light from the light emitting diode and direct the light onto the light detector by total internal reflection. The prism is shaped so that if it becomes wet, such as when the remote unit 30 is immersed in water, its internal reflection characteristics change, allowing the light to substantially escape from the prism, essentially not reaching the light detector. The drop in light intensity reaching the detector thereby causes a change in the remote unit radio signal, activating the alarm in the base unit 10. The remote unit's timing pulse generator 35, shown schematically in FIG. 2, responsive to the water sensor produces a change in the pulse rate for the remote unit radio signal. The base unit code status detector 21, as shown in FIG. 1, interprets the received signal's pulse rate so that a predetermined display, alarm, or combination thereof is activated in the base unit to warn the operator of the status of the remote unit.

In addition, the remote unit 30 contains a dye pack release mechanism 34, which may be in any form known in the art, including for example a dye capsule. The dye pack mechanism 34 is configured to release dye within a very short time upon immersion in water. This feature of the remote unit 30 is particularly useful for finding a child, or other subject, who may be submerged in turbid or murky water. The dye will be released preferably within approximately fifteen seconds of the remote unit 30 being submerged, however, this preferred time is not to be construed as a limitation in the operation of the invention. As an additional locating aid, the remote unit alarm may include a visual indicator responsive to the water sensor, such as a strobe light to aid in finding the wearer of the remote unit in the dark.

The remote unit 30 provides yet another aid to finding a subject who is under the water. The remote unit 30 is substantially water resistant, so that the circuitry will remain functioning for a period of time when the unit is submerged. The water sensor 33, however, is positioned so that it will become wet if the unit is under water, thereby altering the remote unit radio signal, and setting off the alarm in the base unit 10. The submerged remote unit 30 may also be generally tracked by the base unit 10 through its radio signal, within a limited distance and depth of water.

The personal monitoring apparatus may further include a portable base unit 10 in radio communication with the remote unit 30, for enabling the operator to monitor the whereabouts of the remote unit 30, which is connected to or otherwise carried in some way by the subject being monitored. The portable base unit 10 includes a base unit power supply 19, a radio transmitter for sending the base unit radio signal, a radio receiver for receiving the substantially continuous remote unit radio signal, a distance estimating function for substantially estimating the distance between the base unit 10 and the remote unit 30, and a base unit alarm 23 responsive to the substantially constant remote unit radio signal so that the base unit alarm is activated when the remote unit radio signal is substantially altered or disrupted. The base unit power supply 19 may be any power supply known in the art which allows the base unit 10 to be portable, but is preferably a battery. An alternate power supply, for example, might be a solar panel for generating electricity. The radio transmitter/receiver 17 for the portable base unit 10 would be essentially as described for the remote unit 30. The portable base unit alarm 23 preferably activates within a few seconds responsively to alteration in or loss of remote unit radio signal, which would occur almost immediately upon submersion of the remote unit 30 in water. In addition, the base unit 10 preferably includes the option of manually activating the base unit transmitter to send a base unit radio signal useful for activating the remote unit alarm, The monitoring operator could use this feature, for example, to signal the subject to return to the base unit 10.

The base unit transmitter/receiver 17 operates in conjunction with the signal strength detector, which will be understood by those skilled in the art to provide an indicator of distance from the base unit 10 to the remote unit 30 by estimating from signal strength information.

Figure 5:
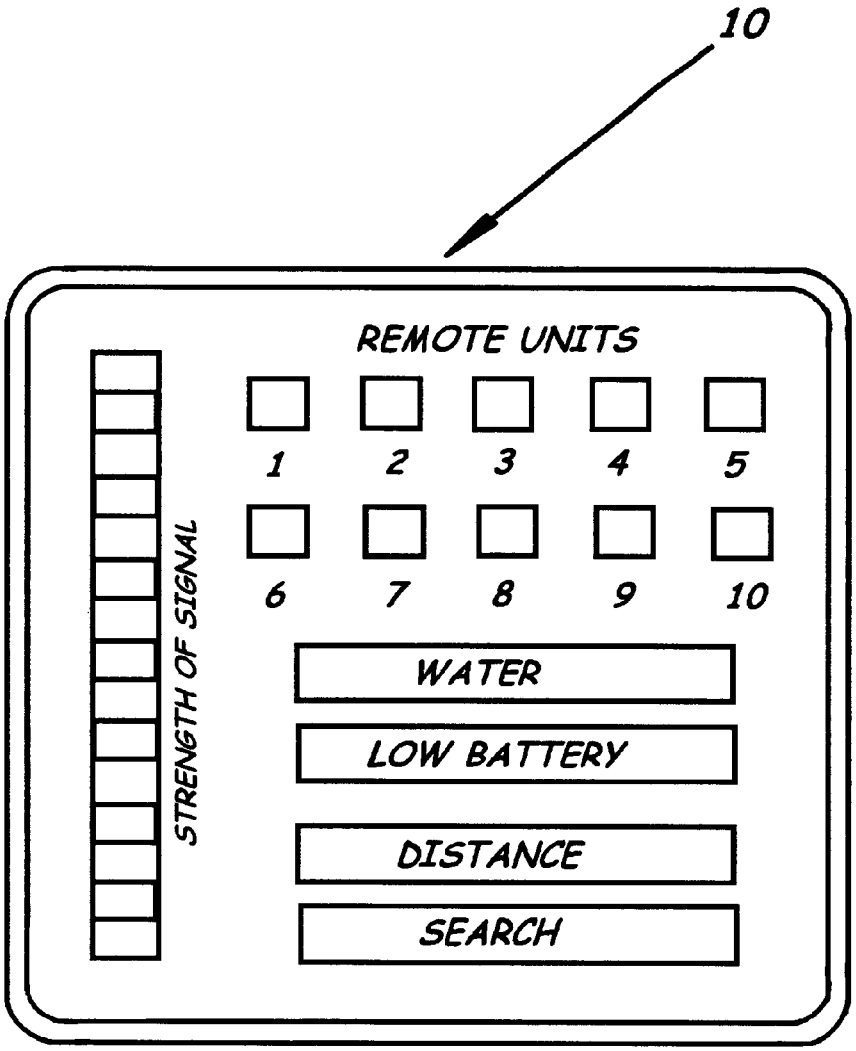
FIG. 5 shows a preferred embodiment for a portable base unit.

In one preferred embodiment of the personal monitoring apparatus, the remote unit alarm is responsive to the distance estimate made by the base unit, so that the remote unit alarm is activated from the base unit when the distance between the remote unit 30 and the base unit 10 essentially exceeds a predetermined distance. This is a particularly useful feature for use with a subject who is responsive to commands, perhaps an older child. The alarm will serve as a reminder that the child has strayed too far from mom or dad and needs to turn around and come back toward the base unit 10. Similarly, the base unit alarm is responsive to the distance estimate, so that the base unit alarm is also activated when the distance between the remote unit 30 and the base unit 10 is estimated to essentially exceed a predetermined distance. The base unit alarm will notify the operator having the base unit 10 that the subject has exceeded the predetermined distance, and the operator will be able to go in search of the subject. Additionally, in a preferred embodiment such as shown in FIG. 5, the base unit 10 includes a display which provides visual information responsive to the remote unit radio signal, for example the display color indicates whether activation of the base unit alarm may be due to a remote unit 30 being submerged in water, traveling beyond a predetermined distance from the base unit 10, or simply has a weak battery causing signal strength to wane.

Figure 4:
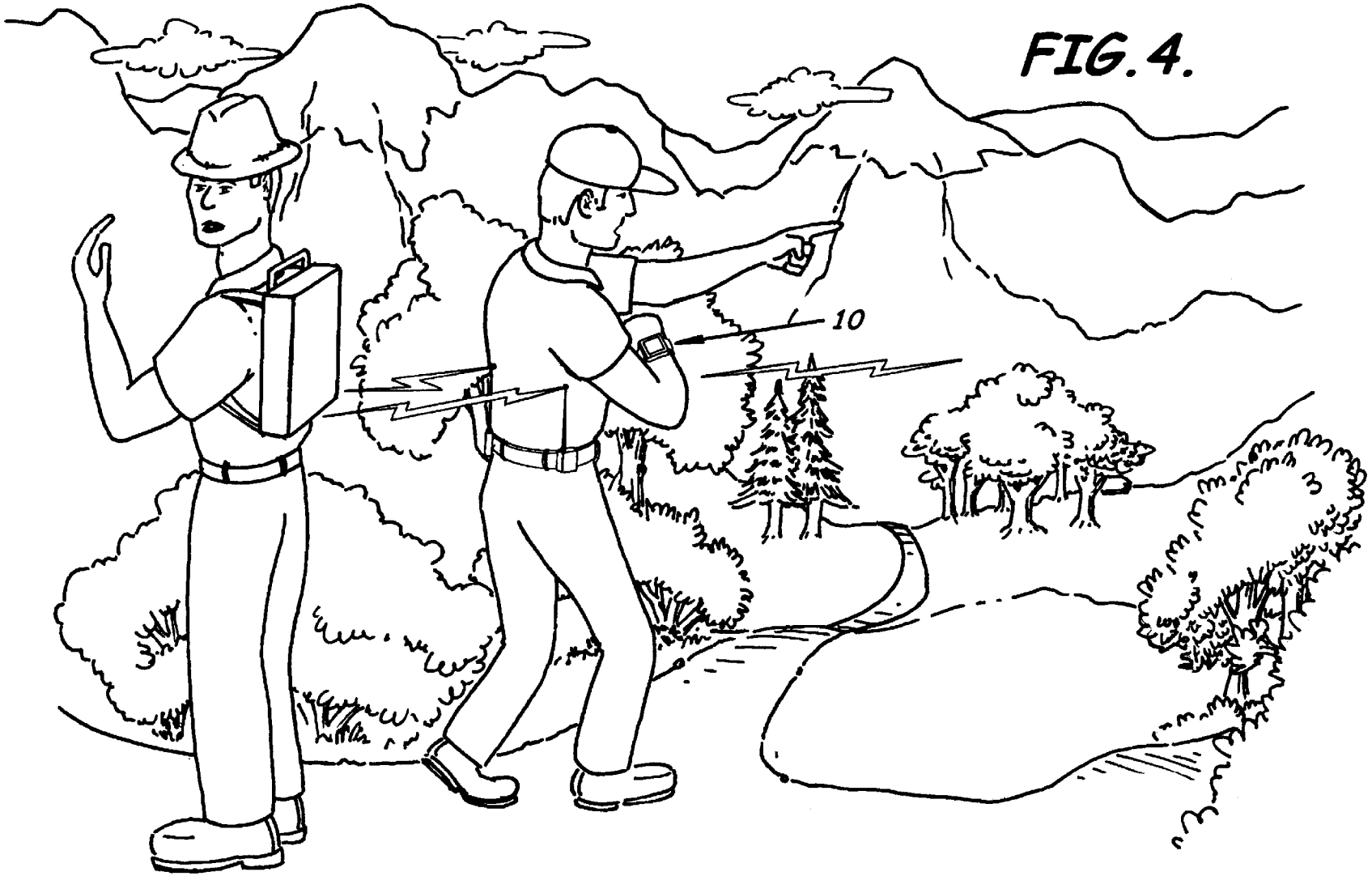
FIG. 4 depicts use of the directional detection capability of the apparatus for searching for a subject.

To aid in finding the subject, the personal monitoring apparatus includes a direction finding function relying on having a plurality of radio antennas detachably connected to the base unit 10, for aiding in determining the general direction from which the remote unit radio signal originates. As illustrated in FIG. 4, these radio antennas may be conveniently connected to the waist of an operator searching for the subject. The antennas may be connected to the operator's belt, or may be worn or carried in any other fashion permitting sufficient signal differentiation relative to signal strength to derive a directional indication, as known to those skilled in the art. Preferably, a signal strength visual indicator, as best shown in FIG. 5, will indicate fluctuating signal strength as the operator turns his body in a circle thereby rotating the orientation of the base unit antennas. Such usage is illustrated in FIG. 4, the operator following the direction from which the strongest signal is received, as shown on the display.

In yet another preferred embodiment, the personal monitoring apparatus includes a plurality of remote units, so that the base unit 10 is in radio communication with the plurality of remote units, thereby allowing the operator to monitor the whereabouts of a plurality of subjects. This function is particularly useful for monitoring groups of children by one adult. Additionally, the remote unit radio signal of each remote unit 30 of the plurality includes a remote unit identifier which enables the base unit 10 to differentiate between remote units, thereby allowing the operator to use a single base unit 10 to individually monitor multiple remote units. The remote unit identifier is preferably a modulated radio signal code which identifies the individual remote unit 30, thereby allowing the base unit 10 to discriminate between the various remote units. The number of remote units which may be monitored in this fashion from a single base unit 10 is preferably dictated by practicality, and according to the state of the art as known to its artisans. In the present invention it is estimated that a practical ratio of remote units to base units would be about nine remote units to one base unit 10, however, this is not to be taken as an absolute limitation. Such multiple monitoring would be very useful in settings involving groups, such as in camping excursions, outings, daycares, etc.

Figure 3:
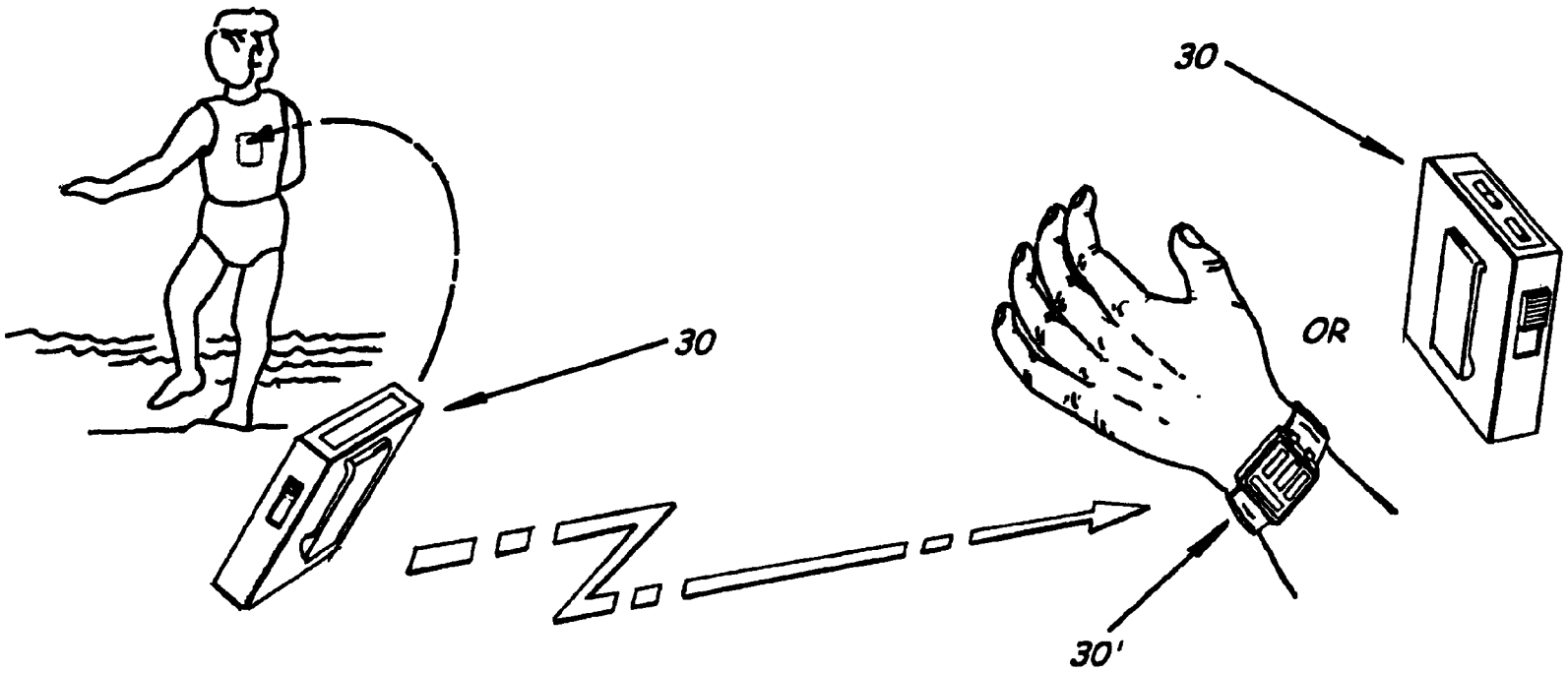
FIG. 3 illustrates use of an embodiment of the remote unit positioned in a shirt and a base unit configured as a wrist band.

In other preferred embodiments, the base unit 10 and the remote unit 30 may be designed into a garment or accessory for wear by the monitoring operator, by the subject, or both, thereby making the units easily portable and unobtrusive. For example, the personal monitoring apparatus may be configured into a wrist band, a waist pack, a back pack, a pendant, a hat, a bag, or any other desired accessory. In addition, the remote unit 30 may be housed in a garment worn by the subject, thereby connecting the remote unit to the subject. The remote unit may be housed within a shirt, a vest, or a jacket, being positioned thereon so as to be substantially secure from tampering by the subject. Securing the remote unit from tampering by the subject may be accomplished in any number of ways. For example, the remote unit 30 may be within a secure pocket on the back of a shirt or vest for wearing by a child, as best shown in FIG. 3. Other methods similarly effective for securing the remote unit from tampering will become apparent to those having skill in the art. In cases where the subject may be a pet animal, for example, the garment may be configured as a harness and the remote unit 30 may be positioned thereon so as to be substantially secure from tampering by the subject. In such a case, the remote unit 30 may be enclosed in an impact resistant container such as a small case having a securely closing lid.

In yet other preferred embodiments of the invention, the personal monitoring apparatus may be included within a garment intended to cover the lower part of the body, such as a pair of shorts, a pair of pants, a pair of training pants, and a diapers and the remote unit 30 may be positioned thereon so as to be substantially secure from tampering by the subject.

For portability of the personal monitoring apparatus, the base unit power supply 19 and the remote unit power supply are preferably batteries, and particularly preferable, rechargeable batteries. For use with rechargeable batteries, the base unit 10 is electrically configured for recharging the batteries. Additionally useful, the base unit 10 and the remote unit 30 further include a low power indicator, to alert users of low power conditions in the batteries. As with the base unit alarm, remote unit alarm, and signal strength indicator, the low power indicator may be provided in a visible or audible format, or both. In general, the visible displays in the present invention may be any device, and may be arranged in any configuration known to skilled artisans, including liquid crystal display, light emitting diodes, signal strength meters, or others. All electrical circuitry included in the present invention is conventional in nature, and is well known to those having skill in the art.

Additionally, as illustrated in FIGS. 1–5, the present invention also includes associated methods for an operator to monitor the whereabouts of a subject. A preferred method includes the step of connecting a portable remote unit 30 to the subject, the remote unit including a remote unit power supply, a radio transmitter for sending a substantially constant remote unit radio signal, a radio receiver for receiving a base unit radio signal, a remote unit alarm, a water sensor, and a dye pack for releasing dye substantially responsive to submersion of the remote unit in water. The method also includes the step of monitoring a portable base unit 10 in radio communication with the remote unit 30 for enabling the operator to substantially track the whereabouts of the remote unit, the base unit 10 including a base unit power supply 19, a radio transmitter for sending the base unit radio signal, a radio receiver for receiving the substantially continuous remote unit radio signal, a distance estimator for substantially estimating the distance between the base unit 10 and the remote unit 30, a base unit alarm responsive to the substantially continuous remote unit radio signal so that the base unit alarm means is activated when the remote unit radio signal is substantially disrupted, and a direction finder for generally indicating the direction from which the remote signal originates.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A personal monitoring apparatus for monitoring the whereabouts of a subject, the apparatus comprising:

a) a portable remote unit connected to the subject, said remote unit including a remote unit power supply, a water sensor comprising a prism light collector responsive to wetting, a light source positioned adjacent a first side of said prism so that light from the light source is collected in said prism and internally reflected toward a second side of said prism to exit therefrom, and a light detector positioned adjacent said second side for detecting the internally reflected light exiting said prism, a radio transmitter for sending a remote unit radio signal substantially responsive to the water sensor, a radio receiver for receiving a base unit radio signal, and a remote unit alarm, wherein said water sensor is positioned so that said prism light collector will become wet when said portable remote unit is immersed in water, the light collection characteristics of said light collector being changed thereby; and b) a base unit in radio communication with the remote unit, the base unit including a base unit power supply, a radio transmitter for sending the base unit radio signal, a radio receiver for receiving the remote unit radio signal, a distance estimator for substantially estimating the distance between the base unit and the remote unit, a base unit alarm responsive to said remote unit radio signal, and a direction finder for generally finding the direction from which the remote unit signal originates relative to said base unit.

2. The personal monitoring apparatus of claim 1, wherein the remote unit alarm is responsive to the distance estimator so that the remote unit alarm is activated when the distance between the remote unit and the base unit substantially exceeds a predetermined distance.

3. The personal monitoring apparatus of claim 1, wherein the base unit alarm is responsive to the distance estimator so that the base unit alarm is activated when the distance between the remote unit and the base unit substantially exceeds a predetermined distance.

4. The personal monitoring apparatus of claim 3, wherein the base unit includes a display providing information responsive to the remote unit radio signal, to thereby substantially aid the operator in determining whether base unit alarm activation is due to the remote unit being submerged in water or the remote unit being beyond a predetermined distance from the base unit.

5. The personal monitoring apparatus of claim 1, wherein the direction finder includes a plurality of radio antennas detachably connected spaced-apart to the base unit, for aiding in substantially determining the signal strength of the remote unit radio signal relative to a direction from the base unit.

6. The personal monitoring apparatus of claim 1, further including a plurality of remote units, so that the base unit is in radio communication with each remote unit of said plurality of remote units, to thereby monitor the whereabouts of a plurality of subjects.

7. The personal monitoring apparatus of claim 6, wherein the remote unit radio signal of each remote unit of said plurality of remote units includes a remote unit identifier, and wherein the base unit is responsive to said remote unit identifier, to thereby monitor each remote unit of said plurality.

8. The personal monitoring apparatus of claim 7, wherein the base unit is selectively responsive to said remote unit identifier and displays information for each remote unit of said plurality, to thereby individually monitor each remote unit of said plurality, to thereby individually monitor each remote unit of the plurality of remote units.

9. The personal monitoring apparatus of claim 1, wherein the base unit power supply is a battery and the base unit is positioned in a portable housing.

10. The personal monitoring apparatus of claim 1, wherein said base unit power supply includes a battery and the base unit is positioned in a housing connected to a garment or accessory worn by an operator, to thereby make the base portable.

11. The personal monitoring apparatus of claim 10, wherein said garment or accessory is selected from a wrist band, a waist pack, a back pack, a pendant, a hat, and a bag.

12. The personal monitoring apparatus of claim 1, wherein the remote unit is positioned in a remote unit housing worn by the subject, to thereby connect the remote unit to the subject.

13. The personal monitoring apparatus of claim 12, wherein the remote unit housing is selected from a shirt, a blouse, a vest, a jacket, a harness, a pair of shorts, a pair of pants, a pair of training pants, and a diaper.

14. The personal monitoring apparatus of claim 1, wherein the remote unit alarm includes at least one alarm selected from a light source responsive to said water sensor and a dye pack for releasing dye substantially responsive to submersion of the remote unit in water.

15. The personal monitoring apparatus of claim 10, wherein the battery in the base unit is rechargeable and the base unit is electrically configured for recharging said battery.

16. The personal monitoring apparatus of claim 1, wherein the base unit and the remote unit further include a low power indicator.

17. The personal monitoring apparatus of claim 1, wherein the direction finder further includes a visual display for aiding in finding the remote unit.

18. The apparatus of claim 1, wherein said water sensor is positioned so that said light collector will become wet when said portable remote unit is immersed in water, the light collection characteristics of said light collector being changed thereby.

19. The apparatus of claim 1, wherein said light detector is responsive to a change in intensity of light collected within said light collector upon said light collector becoming wet.

20. The apparatus of claim 1, wherein said portable remote unit radio transmitter transmits a remote unit radio signal having an altered pulse rate responsive to said water sensor becoming wet.

21. A method for monitoring the whereabouts of a subject, the method comprising:

a) connecting a portable remote unit to the subject, the remote unit including a remote unit power supply, a water sensor comprising a prism light collector responsive to wetting, a light source positioned adjacent a first side of said prism so that light from the light source is collected in said prism and internally reflected toward a second side of said prism to exit therefrom, and a light detector connected to said power supply and positioned adjacent said second side for detecting the internally reflected light exiting said prism, a radio transmitter responsive to said water sensor for sending a remote unit radio signal, a radio receiver for receiving a base unit radio signal, a remote unit alarm responsive to said base unit radio signal, and a dye pack for releasing dye substantially responsive to submersion of the remote unit in water, wherein said water sensor is positioned so that said prism light collector will become wet when said portable remote unit is immersed in water, the light collection characteristics of said light collector being changed thereby; and b) monitoring the remote unit radio signal from a base unit in radio communication with the remote unit, said base unit including a base unit power supply, a radio transmitter for sending the base unit radio signal, a radio receiver for receiving the remote unit radio signal, a distance estimator for substantially estimating the distance between the base unit and the remote unit, a base unit alarm responsive to said remote unit radio signal, and a direction finder for generally indicating the direction from which the remote unit signal originates relative to the base unit.

22. The method of claim 21, wherein the remote unit alarm is responsive to the distance estimator, so that the remote unit alarm is activated when the distance between the remote unit and the base unit substantially exceeds a predetermined distance.

23. The method of claim 21, wherein the base unit alarm is responsive to said distance estimator, so that the base unit alarm is activated when the distance between the remote unit and the base unit substantially exceeds a predetermined distance.

24. The method of claim 23, wherein the base unit includes a display providing information responsive to the remote unit radio signal, to thereby substantially aid the operator in determining whether base unit alarm activation accessory worn by the operator, to thereby make the base portable by the operator.

25. The method of claim 21, wherein the direction finder includes a plurality of radio antennas detachably connected spaced-apart to the base unit, for aiding in substantially determining the signal strength of the remote unit radio signal relative to a direction from the base unit.

26. The method of claim 21, further including a plurality of remote units, so that the base unit is in radio communication with said plurality of remote units, to thereby monitor the whereabouts of a plurality of subjects.

27. The method of claim 26, wherein the remote unit radio signal of each remote unit of said plurality of remote units includes a remote unit identifier, and wherein the base unit is responsive to said remote unit identifier, to thereby individually monitor each remote unit of said plurality.

28. The method of claim 27, wherein the base unit is selectively responsive to said remote unit identifier and displays information for each remote unit of said plurality, to thereby individually monitor each remote unit of the plurality of remote units.

29. The method claim 21, wherein said base unit power supply includes a battery and the base unit is positioned in a housing connected to a garment or accessory worn by an operator, to thereby make the base portable.

30. The method claim 29, wherein said accessory is selected from a wrist band, a wrist pack, a back pack, a pendant, a hat, and a bag.

31. The method of claim 21, wherein the remote unit is housed in a garment or accessory worn by the subject, to thereby connect the remote unit to the subject.

32. The method of claim 31, wherein the garment or accessory is selected from a shirt, a vest, a jacket, a harness, a pair of shorts, a pair of pants, a pair of training pants, and a diaper, and the remote unit is positioned thereon so as to be substantially secure from tampering by the subject.

33. The method of claim 21, wherein the remote unit alarm includes a light source responsive to said water sensor.

34. The method of claim 29, wherein the battery in the base unit is rechargeable and the base unit is electrically configured for recharging said battery.

35. The method of claim 21, wherein the base unit and the remote unit further include a low power indicator.

36. The method of claim 21, wherein the direction finder further includes a display for visually indicating the general direction from the base unit to the remote unit.

37. A personal monitoring apparatus for monitoring the whereabouts of a plurality of subjects, comprising:

a) a plurality of portable remote units, each unit of said plurality having a water sensor comprising a prism light collector responsive to wetting, a light source positioned adjacent a first side of said prism so that light from the light source is collected in said prism and internally reflected toward a second side of said prism to exit therefrom, and a light detector positioned adjacent said second side for detecting the internally reflected light exiting said prism, a radio transmitter responsive to said water sensor for sending a remote unit radio signal including a remote unit identifier, an impact resistant housing positioned on a garment worn by the subject, a remote unit power supply, a radio receiver for receiving a base unit radio signal, a remote unit alarm responsive to a predetermined base unit radio signal, and at least one location aid selected from a dye pack, an emergency signaling light source, and an audible sound, wherein said water sensor is positioned so that said prism light collector will become wet when said portable remote unit is immersed in water, the light collection characteristics of said light collector being changed thereby; and b) a portable base unit in radio communication with each remote unit of said plurality, said base unit including a power supply, a radio transmitter for sending the base unit radio signal, a radio receiver for receiving and for identifying the remote unit radio signal from each remote unit, a distance estimator for substantially estimating distance between the base unit and each remote unit, a direction finder for generally finding the direction relative to the base unit from which each remote unit signal originates, and a base unit alarm and display responsive to the remote unit radio signal from each remote unit and to said distance estimator.

38. A method of monitoring a subject to help prevent accidental drowning, the method comprising:

a) attaching to the subject a unit having a radio transmitter and power supply responsively connected to a water sensor comprising a prism, a light source adjacent a first side of the prism so that emitted light is collected in the prism and internally reflected toward a second side of the prism, and a light detector adjacent the second side for detecting the internally reflected light;

wetting at least the first side of the prism to thereby change the internal reflection characteristics of the prism to allow light to substantially escape therefrom;

detecting a change in intensity of light reaching the light detector responsive to the change in the internal reflection characteristics of the prism;

generating a radio signal responsive to detecting a change in intensity of light; and monitoring the radio signal as an indicator that the subject has come into contact with a liquid thereby wetting the prism in the unit so as to generate the radio signal.

* * * * *